US009994409B1

(12) United States Patent
Chou

(10) Patent No.: US 9,994,409 B1
(45) Date of Patent: Jun. 12, 2018

(54) DOCUMENT STORAGE ASSEMBLY

(71) Applicant: MASTERWORK AUTOMODULES TECHNOLOGY CORP., LTD, Taipei (TW)

(72) Inventor: Hung-Hsun Chou, New Taipei (TW)

(73) Assignee: MASTERWORK AUTOMODULES TECHNOLOGY CORP., LTD, Taipei (TW)

( * ) Notice: Subject to any disclaimer, the term of this patent is extended or adjusted under 35 U.S.C. 154(b) by 0 days. days.

(21) Appl. No.: 15/805,116

(22) Filed: Nov. 6, 2017

(30) Foreign Application Priority Data

Feb. 17, 2017 (TW) ..... 106105355 A

(51) Int. Cl.
*B65H 29/46* (2006.01)
*B65H 31/06* (2006.01)
*B65D 85/62* (2006.01)

(52) U.S. Cl.
CPC ..... *B65H 31/06* (2013.01); *B65D 85/62* (2013.01)

(58) Field of Classification Search
CPC ..... B65H 29/46; B65H 31/06
USPC ..... 271/180, 181
See application file for complete search history.

(56) References Cited

U.S. PATENT DOCUMENTS 4,809,966 A * 3/1989 Kobayashi ..... B65H 29/46 194/206
5,641,157 A * 6/1997 Mays ..... G07D 11/0012 271/181
5,676,366 A 10/1997 Polidoro
8,864,126 B2 10/2014 Snider et al.
2006/0157918 A1* 7/2006 Gaber ..... B65H 29/46 271/180
2010/0276866 A1* 11/2010 Nireki ..... B65H 29/46 271/10.02
2011/0198191 A1* 8/2011 Nireki ..... B65H 29/46 194/206
2015/0213668 A1* 7/2015 Ito ..... G07F 7/04 194/206
2016/0221786 A1* 8/2016 Seki ..... G07D 11/0012

* cited by examiner

*Primary Examiner* — David H Bollinger
(74) *Attorney, Agent, or Firm* — CKC & Partners Co., Ltd.

(57) ABSTRACT

The present disclosure is to provide a document storage assembly including a housing, a guiding plate, a supporting plate, and a displacement assembly. The supporting plate has at least one engagement structure, in which the guiding plate and the supporting plate define a storage space therebetween. The displacement assembly is configured to move the supporting plate towards or away from the guiding plate along a direction, in which the displacement assembly includes at least one first belt, at least one second belt, and a synchronous transmission assembly. The first belt has an engaging section parallel to the direction and is engaged with the engagement structure. The second belt is located under the storage space and has a supporting section parallel to the direction. The synchronous transmission assembly is configured to drive the engaging section and the supporting section to move at the same speed.

20 Claims, 9 Drawing Sheets

DOCUMENT STORAGE ASSEMBLY

CROSS-REFERENCE TO RELATED APPLICATION

This application claims priority to Taiwan Application Serial Number 106105355, filed Feb. 17, 2017, which is herein incorporated by reference.

BACKGROUND

Field of Invention

The present invention relates to a storage assembly for storing documents. More particularly, the present invention relates to a document storage device for storing documents in stacks. Without departing from the spirit of the present invention, the documents may be banknotes, papers, bills, tickets, security papers, currency, checks or any other flexible planar object, and the present invention is not limited thereto.

Description of Related Art

Nowadays, a conventional banknote storage apparatus generally has a banknote handling module and a banknote storage module disposed therein. A user may input banknotes one by one into the banknote handling module through an inlet/outlet of the conventional banknote handling apparatus. The banknote handling module is primarily in charge of orderly feeding, conveying, and discriminating the banknotes. The banknote storage module is primarily used to store the banknotes conveyed by the banknote handling module.

U.S. Pat. No. 5,676,366 discloses a banknote storage apparatus for stacking banknote including a guiding plate, a supporting plate, and a pushing plate. The guiding plate is located between the supporting plate and the pushing plate. Banknotes received by a banknote managing module will arrive at a side of the guiding plate facing the pushing plate. The guiding plate has a passage, and the pushing plate may push the banknotes through the passage to reach a side of the guiding plate facing the supporting plate. As such, the banknotes may be stored within a storage space between the guiding plate and the supporting plate.

However, the guiding plate, supporting plate, and the pushing plate of the banknote storage module are arranged in a row, so that, while the pushing plate is pushing the banknotes into the storage space between the guiding plate and the supporting plate, the banknotes will fall down due to the friction rubbing with a bottom side of a housing of the banknote storage module, thus the banknotes fail to be arranged orderly in the storage space.

Thus, there is a need to provide a banknote handling apparatus that can overcome the aforementioned problems in the industry.

SUMMARY

One aspect of the present disclosure is to provide a document storage assembly including a housing, a guiding plate, a supporting plate, and a displacement assembly. The guiding plate is disposed in the housing. The supporting plate is disposed in the housing and has at least one engagement structure, in which a storage space is defined between the guiding plate and the supporting plate. The displacement assembly is disposed in the housing, and is configured to move the supporting plate towards or away from the guiding plate along a direction, in which the displacement assembly includes at least one first belt, at least one second belt, and a synchronous transmission assembly. The at least one first belt has an engaging section parallel to the direction, and is engaged with the engagement structure. The at least one second belt is located under the storage space, and has a supporting section parallel to the direction. The synchronous transmission assembly is operatively connected to the first belt and the second belt, and is configured to drive the engaging section and the supporting section to move at the same speed.

In some embodiments, the displacement assembly further includes at least one first gear and at least one second gear. The at least one first gear is rotatably disposed in the housing, in which the first belt is sleeved onto the first gear, so as to be driven by the first gear. The at least one second gear is rotatably disposed in the housing, in which the second belt is sleeved onto the second gear, so as to be driven by the second gear.

In some embodiments, the displacement assembly further includes a first rotating shaft and a second rotating shaft. The first rotating shaft is rotatably disposed in the housing, in which the first gear is sleeved onto the first rotating shaft. The second rotating shaft is rotatably disposed in the housing, in which the second gear is sleeved onto the second rotating shaft.

In some embodiments, the synchronous transmission assembly further includes a third gear, a fourth gear, and a third belt. The third gear is sleeved onto the first rotating shaft. The fourth gear is sleeved onto the second rotating shaft. The third belt is sleeved onto the third gear and the fourth gear, so as to be driven by the third gear and the fourth gear.

In some embodiments, the displacement assembly further includes at least one supporting wheel rotatably disposed in the housing, in which the supporting section of the second belt is supported on the supporting wheel.

In some embodiments, the displacement assembly further includes plural supporting wheels, and the supporting wheels are arranged along the direction.

In some embodiments, the document storage assembly further includes a torsion spring sleeved onto the first rotating shaft. The torsion spring has a first end and a second end, in which the first end is fixed to the first rotating shaft and the second end is configured to abut against an inner wall of the housing.

In some embodiments, the displacement assembly includes two first belts (i.e. the number of the at least first belts is two), and further includes two first gears, a first rotating shaft, and a second rotating shaft. The two first gears are rotatably disposed in the housing, in which the first belts are sleeved onto the first gears respectively, so as to be driven by the first gears. The first rotating shaft is rotatably disposed in the housing, in which one of the first gears is sleeved onto the first rotating shaft. The second rotating shaft is rotatably disposed in the housing, in which the other one of the first gears is sleeved onto the second rotating shaft.

In some embodiments, the engaging section has a first meshing portion, and the engagement structure further includes a sliding block and an abutting member. The sliding block has a guiding groove configured to accommodate a portion of the engaging section, in which the guiding groove has a second meshing portion engaged with the first meshing portion. The abutting member is disposed in the guiding groove, and is configured to prevent the first meshing portion from disengaging from the second meshing portion.

In some embodiments, the engagement structure further includes a fastening member configured to fasten the abutting member to the sliding block.

In some embodiments, the document storage assembly further includes two guiding bars that are disposed on an inner wall of the housing and substantially extend along the direction, in which the sliding block is limited between the guiding bars.

In some embodiments, the document storage assembly further includes two guiding stages disposed in the housing. The guiding stages are adjacent to two side edges of the guiding plate and the supporting plate respectively, in which the storage space is further defined within the guiding stages.

In some embodiments, the guiding plate further has a passage, and the document storage assembly further includes a fixing member, a pushing plate, a connecting assembly, and a power transmission assembly. The fixing member is disposed in the housing, in which the guiding plate is located between the fixing member and the supporting plate. The pushing plate is disposed in the housing, and is configured to pass through the passage to abut against the supporting plate. The connecting assembly is connected between the fixing member and the pushing plate, and is configured to drive the pushing plate to move towards or away from the fixing member along the direction. The power transmission assembly is disposed in the housing, and includes a cam structure and a driven member. The cam structure is rotatably disposed in the housing and having a cam rail. The driven member is connected to the connecting assembly, and is engaged with the cam rail, in which the cam structure is configured to drive the connecting assembly by using the driven member, so as to drive the pushing plate to move towards or away from the fixing member.

Another aspect of the present disclosure is to provide a document storage assembly including a housing, a fixing member, a pushing plate, a scissors-like linkage set, and a power transmission assembly. The fixing member is disposed in the housing, and has a first pivoting portion and a first sliding groove. The pushing plate is disposed in the housing opposite to the fixing member, and has a second pivoting portion and a second sliding groove, in which the first sliding groove and the second sliding groove are located at same side of the first pivoting portion and the second pivoting portion respectively. The scissors-like linkage set includes a first linkage and a second linkage. The first linkage has a first pivoting end and a first sliding end engaged with the first pivoting portion and the second sliding groove respectively. The second linkage has a second pivoting end and a second sliding end engaged with the second pivoting portion and the first sliding groove respectively. The power transmission assembly is disposed in the housing, and includes a driving arm connected to the scissors-like linkage set, in which the power transmission assembly is configured to drive the scissors-like linkage set by using the driving arm, so as to move the pushing plate towards or away from the fixing member.

In some embodiments, the driving arm has a long slot, and the power transmission assembly further includes a gear plate and a bump. The gear plate is rotatably disposed in the housing. The bump is disposed on a plate surface of the gear plate, and is slidably engaged into the long slot.

Yet another aspect of the present disclosure is to provide a document storage assembly including a housing, a guiding plate, a supporting plate, a pushing plate, and a displacement assembly. The guiding plate is disposed in the housing, and has a passage. The supporting plate is disposed in the housing, in which an edge of the supporting plate has an indentation. The pushing plate is disposed in the housing, and is configured to pass through the passage to abut against the supporting plate. The displacement assembly is disposed in the housing, and is configured to drive the supporting plate to move towards or away from the guiding plate, in which when the supporting plate abuts against the guiding plate, the indentation is configured to enable a workpiece to pass and reach the passage.

In some embodiments, an orthogonal projection of the indentation on the guiding plate partially overlaps with the passage.

In some embodiments, the supporting plate includes two engaging structures, the indentation is located between the engaging structures, and the displacement assembly includes two belts each of which has an engaging section, in which the engaging sections are parallel to a direction, and are engaged with the engaging structures respectively, so as to drive the supporting plate to move towards or away from the guiding plate along the direction.

In some embodiments, the indentation is U-shaped.

In some embodiments, the document storage assembly further includes a fixing member, a pushing plate, a connecting assembly, and a power transmission assembly. The fixing member is disposed in the housing, in which the guiding plate is located between the fixing member and the supporting plate. The pushing plate is disposed in the housing, and is configured to pass through the passage to abut against the supporting plate. The connecting assembly is connected between the fixing member and the pushing plate, and is configured to drive the pushing plate to move towards or away from the fixing member. The power transmission assembly is disposed in the housing, and includes a cam structure and a driven member. The cam structure is rotatably disposed in the housing, and has a cam rail. The driven member is connected to the connecting assembly, and is engaged with the cam rail, in which the cam structure is configured to drive the connecting assembly by using the driven member, so as to drive the pushing plate to move towards or away from the fixing member.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1A:
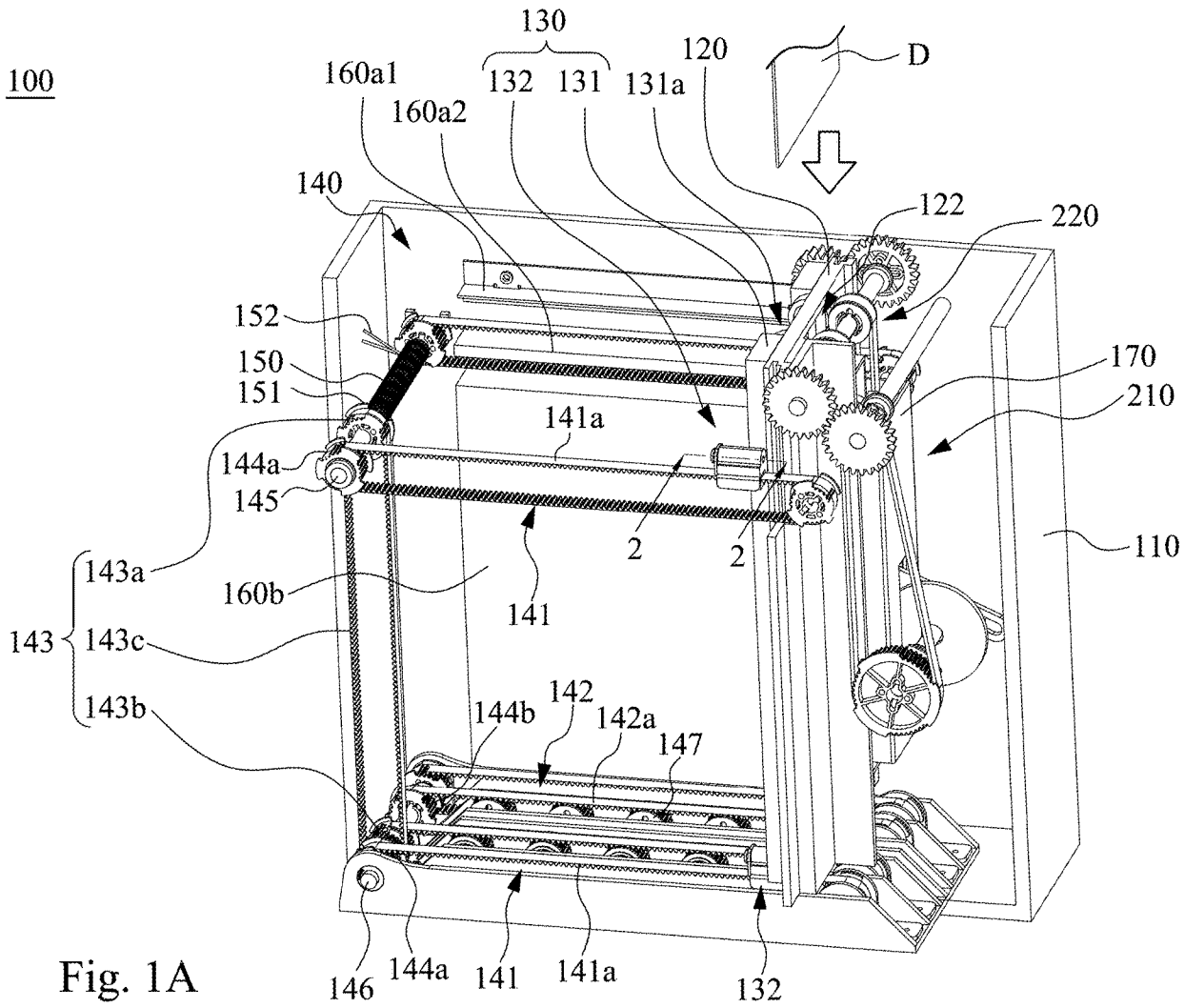
FIG. 1A illustrates a schematic perspective view of a document storage assembly according to an embodiment of the present disclosure, in which a housing is partially removed, and a supporting plate abuts against a guiding plate.

Reference will now be made in detail to the present embodiments of the invention, examples of which are illustrated in the accompanying drawings. Wherever possible, the same reference numbers are used in the drawings and the description to refer to the same or like parts.

Figure 1B:
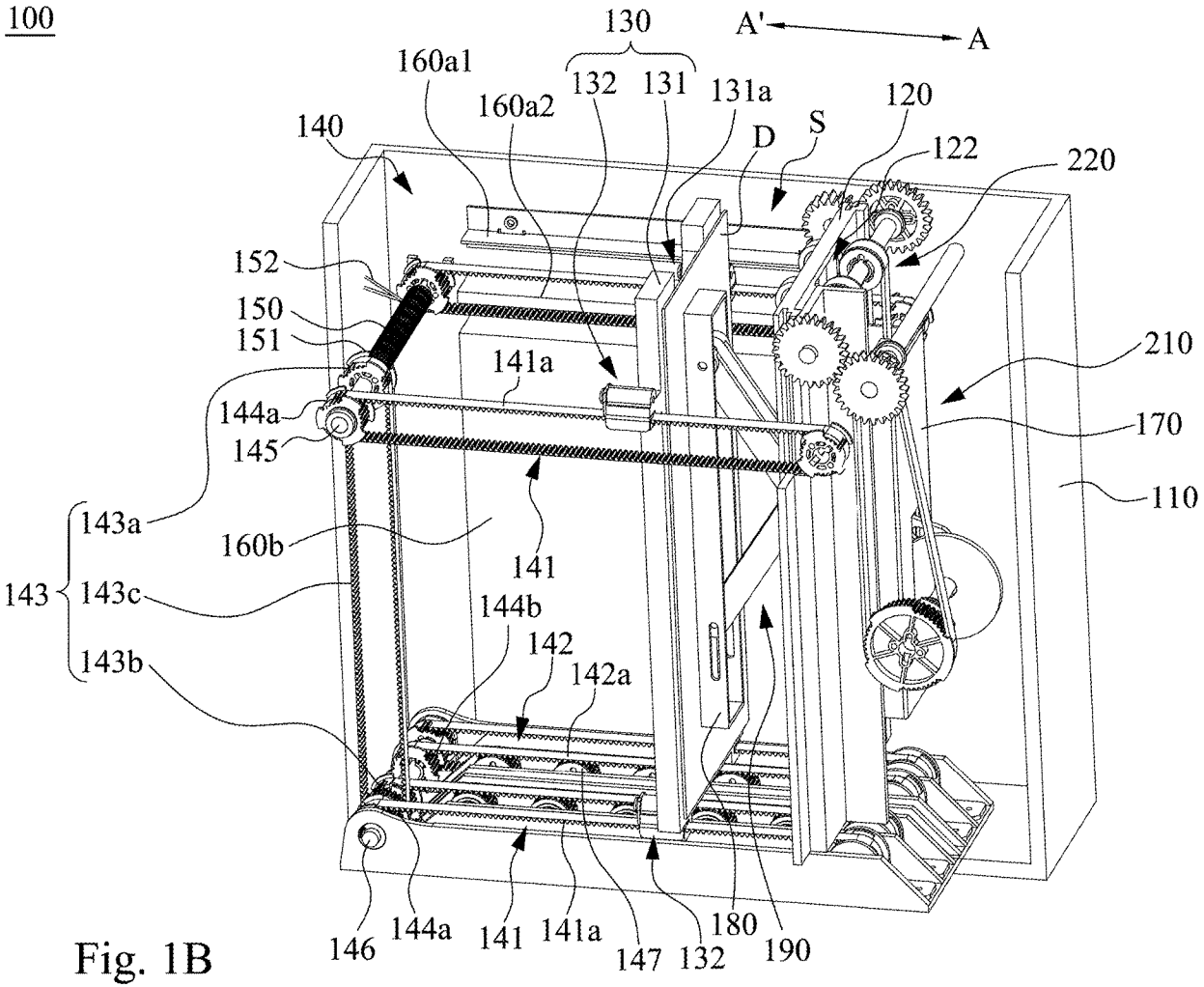
FIG. 1B illustrates another schematic perspective view of the document storage assembly shown in FIG. 1A, in which the supporting plate leaves the guiding plate.

Please refer to FIG. 1A and FIG. 1B. FIG. 1A illustrates a schematic perspective view of a document storage assembly 100 according to an embodiment of the present disclosure, in which a housing 110 is partially removed and a supporting plate 130 abuts against a guiding plate 120. FIG. 1B illustrates another schematic perspective view of the document storage assembly 100 shown in FIG. 1A, in which the supporting plate 130 leaves the guiding plate 120. The structures, functions, and connection and gearing relationship between each of the elements will be described in detail as followings.

As shown in FIG. 1A and FIG. 1B, in the present embodiment, the document storage assembly 100 includes a housing 110, a guiding plate 120, a supporting plate 130, and a displacement assembly 140. The guiding plate 120 is disposed in the housing 110. The supporting plate 130 is disposed in the housing 110, and has a main body 131 and plural engagement structures 132. The engagement structures 132 are connected to the main body 131. The guiding plate 120 and the supporting plate 130 define a storage space S therebetween (See FIG. 1B). The displacement assembly 140 is disposed in the housing 110, and is configured to drive the supporting plate 130 towards or away from the guiding plate 120 along a direction A-A'. The displacement assembly 140 includes four first belts 141, two second belts 142, and a synchronous transmission assembly 143, but the present disclosure is not limited thereto. The first belt 141 has an engaging section 141*a*. The engaging section 141*a* is parallel to the direction A-A', and is engaged with the engagement structures 132. The second belts 142 are located below the storage space S, and have a supporting section 142*a* parallel to the direction A-A'. The synchronous transmission assembly 143 is operatively connected to the first belts 141 and the second belts 142, and is configured to drive the engaging section 141*a* and supporting section 142*a* to move at the same speed.

Specifically, the displacement assembly 140 further includes eight first gears 144*a* (in FIG. 1A, four of the first gears 144*a* are at a top of the figure, other four of the first gears 144*a* are at a bottom of the figure), but only one first gear 144*a* is labeled on each of the top and the bottom of the figure, and four second gears 144*b* (only one of them is labelled in FIG. 1A), but the present disclosure is not limited thereto. The first gears 144*a* are rotatably disposed in the housing 110. Each of the first belts 141 is sleeved onto two corresponding ones of the first gears 144*a*, so as to be driven by the corresponding first gears 144*a*. The second gears 144*b* are rotatably disposed in the housing 110. Each of the second belts 142 is sleeved onto two corresponding ones of the second gears 144*b*, so as to be driven by the corresponding second gears 144*b*.

In the present embodiment, the displacement assembly 140 further includes a first rotating shaft 145 and a second rotating shaft 146. The first rotating shaft 145 is rotatably disposed in the housing 110. Two first gears 144*a* (only one is labelled in FIG. 1A) are sleeved onto the first rotating shaft 145, and two first gears 144*a* (only one is labelled in FIG. 1A) is sleeved onto the second rotating shaft 146. The second rotating shaft 146 is rotatably disposed in the housing 110. Two second gears 144*b* are sleeved onto the second rotating shaft 146, and the two second gears 144*b* are located between the two first gears 144*a*.

In the present embodiment, the synchronous transmission assembly 143 includes a third gear 143*a*, a fourth gear 143*b*, and a third belt 143*c*. The third gear 143*a* is sleeved onto the first rotating shaft 145. The fourth gear 143*b* is sleeved onto the second rotating shaft 146. The third belt 143*c* is sleeved onto the third gear 143*a* and the fourth gear 143*b*, so as to be driven by the third gear 143*a* and the fourth gear 143*b*.

By the aforementioned configuration, after a document D enters the storage space S between the guiding plate 120 and the supporting plate 130, the document D may be supported on the second belts 142 and moved with the supporting plate 130, so as to prevent the document D from falling down due to the friction rubbing with the bottom of the housing 110, thus effectively arranging the stored document D orderly in the storage space S in order.

In the present embodiment, the displacement assembly 140 further includes plural supporting wheels 147. The supporting wheels 147 are rotatably disposed in the housing 110, and are arranged along the direction A-A'. The supporting sections 142*a* of the second belts 142 are supported on the supporting wheels 147. As such, the supporting wheels 147 may support the second belts 142, so as to prevent the second belts 142 from recessed by the weight of the document D.

It should be noted that, four positions of the supporting plate 130 are simultaneously driven by a combination of the four sets of the first gears 144*a* and the first belts 141, and thus it can be guaranteed that the supporting plate 130 may move stably relative to the guiding plate 120. And, by the combination of the two sets of the second gears 144*b* and the second belts 142, and by the supporting of two rows of supporting wheels 147, it can be guaranteed that the document D may be supported stably and uniformly. However, the number of combinations of the first gears 144*a* and the first belts 141, the number of combinations of the second gears 144*b* and the second belts 142, and the number of the supporting wheels 147 are not limited to the foregoing embodiment. In practical application, the number of combinations of the first gears 144*a* and the first belts 141, the number of combinations of the second gears 144*b* and the second belts 142, and the number of the supporting wheels 147 may be flexibly changed according to practical needs or structural limitations.

As shown in FIG. 1A and FIG. 1B, in the present embodiment, the document storage assembly 100 further includes a torsion spring 150. The torsion spring 150 is sleeved onto the first rotating shaft 145, and has a first end 151 and a second end 152. The first end 151 is fixed to the first rotating shaft 145. The second end 152 is configured to abut against an inner wall of the housing 110. As such, the torsion spring 150 is able to apply a torsion force to the first rotating shaft 145, so as to drive the supporting plate 130 to move towards the guiding plate 120, and stably hold the document D between the supporting plate 130 and the guiding plate 120. It should be noted that, in practical application, the torsion spring 150 may also be sleeved onto the second rotating shaft 146 and apply a torsion force to the second rotating shaft 146, the foregoing goal of driving the supporting plate 130 to move towards the guiding plate 120 may be achieved as well.

Figure 2:
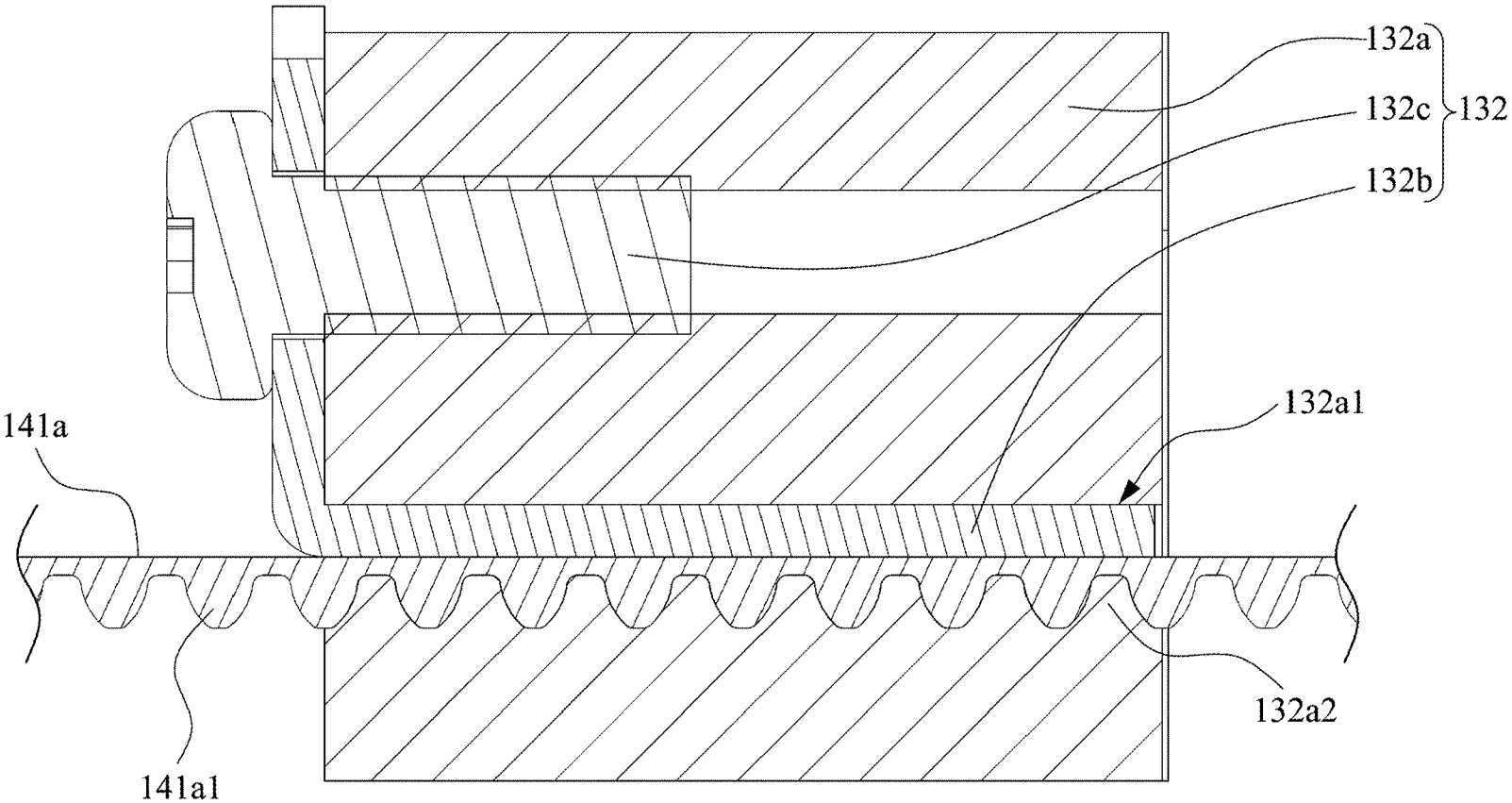
FIG. 2 illustrates a cross-sectional view of an engagement structures shown in FIG. 1A along a line 2-2.

Please refer to FIG. 2, which illustrates a cross-sectional view of the engagement structures 132 shown in FIG. 1A along a line 2-2. As shown in FIG. 2, in the present embodiment, the engaging section 141*a* of the first belt 141 has a first meshing portion 141*a*1 (that is, the rack structure is on the first belts 141). The engagement structure 132 includes a sliding block 132*a* and an abutting member 132*b*. The sliding block 132*a* has a guiding groove 132*a*1. The guiding groove 132*a*1 is configured to accommodate a portion of the engaging section 141*a*, and has a second meshing portion 132*a*2 engaged with the first meshing portion 141*a*1. The abutting member 132*b* is detachably disposed in the guiding groove 132*a*1, and is configured to prevent the first meshing portion 141*a*1 from disengaging from the second meshing portion 132*a*2. That is, when the second meshing portion 132*a*2 is engaged with the first meshing portion 141*a*1 and the abutting member 132*b* is placed into the guiding groove 132*a*1, there is no enough room in the guiding groove 132*a*1 to allow the first meshing portion 141*a*1 to disengage from the second meshing portion 132*a*2. Only when the abutting member 132*b* leaves the guiding groove 132*a*1, there is enough room in the guiding groove 132*a*1 to allow the first meshing portion 141*a*1 to disengage from the second meshing portion 132*a*2.

Furthermore, the engagement structures 132 further includes a fastening member 132*c*. The fastening member 132*c* is configured to fasten the abutting member 132*b* to the sliding block 132*a*. For example, the fastening member 132*c* may be a screw, but the present disclosure is not limited thereto.

As shown in FIG. 1A and FIG. 1B, in the present embodiment, the document storage assembly 100 further includes plural guiding bars 160*a*1 and guiding bars 160*a*2 (only one set of them is labelled in FIG. 1A and FIG. 1B). The guiding bars 160*a*1 and the guiding bars 160*a*2 are disposed on the inner wall of the housing 110, and substantially extend towards the direction A-A'. The sliding block 132*a* of each engagement structure 132 is limited between the corresponding set of the guiding bar 160*a*1 and guiding bar 160*a*2. As such, it can be guaranteed that the supporting plate 130 will move along the direction A-A' relative to the guiding plate 120.

In practical application, at least one of the guiding bars 160*a*1 and the guiding bars 160*a*2 may be a sheet metal, but the present disclosure is not limited thereto.

As shown in FIG. 1A and FIG. 1B, in the present embodiment, the document storage assembly 100 further includes two guiding stages 160*b* (only one of the guiding stages 160*b* is illustrated in FIG. 1A and FIG. 1B). The guiding stages 160*b* are disposed in the housing 110, and are adjacent to two side edges of the guiding plate 120 and the supporting plate 130 respectively. The storage space S is further defined between the guiding stages 160*b*. As such, the guiding stages 160*b* may help arrange the document D stored between the supporting plate 130 and the guiding plate 120 in order without any mess.

Figure 3:
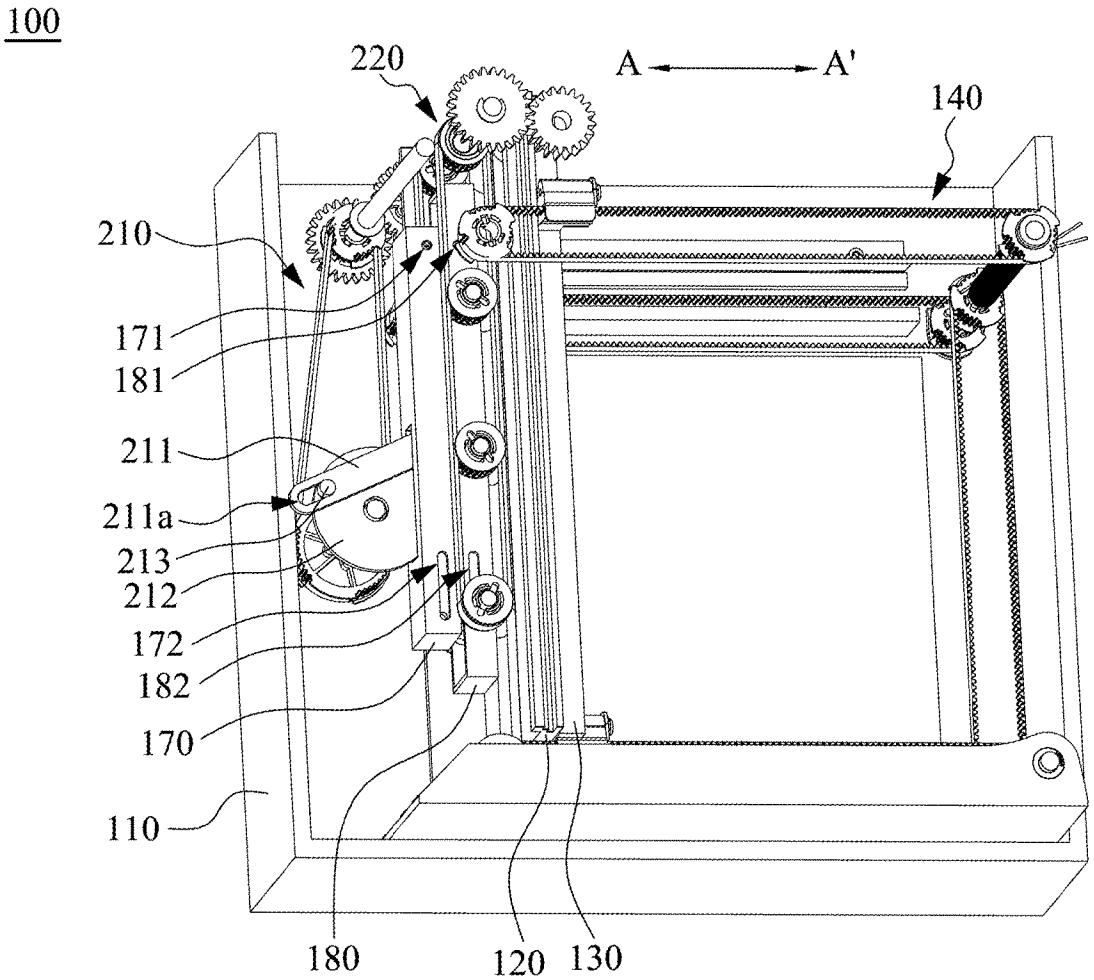
FIG. 3 illustrates a schematic perspective view of the document storage assembly viewed from an opposite side to FIG. 1A according to an embodiment of the present disclosure, in which the housing is partially removed.

Please refer to FIG. 3, which illustrates a schematic perspective view of the document storage assembly 100 shown from an opposite side to FIG. 1A according to an embodiment of the present disclosure, in which the housing 110 is partially removed. As shown in FIG. 1A, FIG. 1B, and FIG. 3, in the present embodiment, the document storage assembly 100 further includes a pushing plate 180 and a document transmission assembly 220. The guiding plate 120 is located between the supporting plate 130 and the pushing plate 180. The document transmission assembly 220 is configured to transfer the document D to a side of the guiding plate 120 facing the pushing plate 180 through a transmission entrance 122 of the guiding plate 120 (see FIG. 1A and FIG. 1B). The guiding plate 120 has a passage 121 (see FIG. 6C), and the pushing plate 180 may push the document D through the passage 121 to reach a side of the guiding plate 120 facing the supporting plate 130. As such, the document D may be stored in the storage space S between the guiding plate 120 and supporting plate 130, as shown in FIG. 1B. The detail structures of the document transmission assembly 220 are not introduced herein, because one with ordinary skill in the art may easily implement any appropriate document transmission assembly 220 to achieve the aforementioned functionality.

Figure 4B:
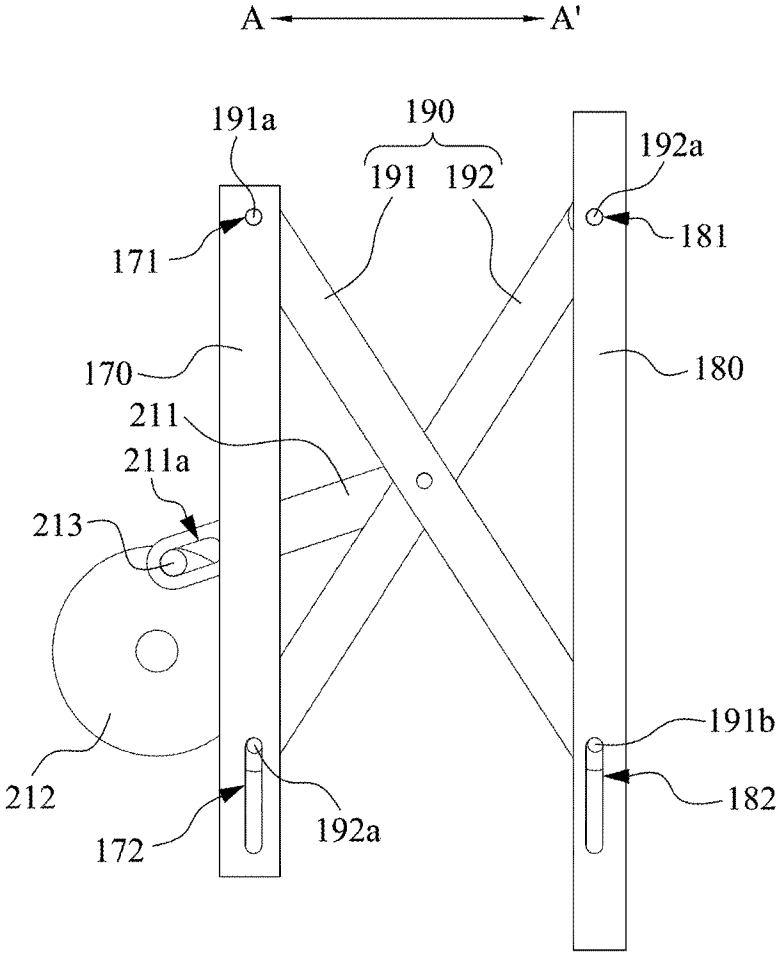
FIG. 4B illustrates another schematic view of the elements shown in FIG. 4A, in which the scissor-like linkage set 190 is unfolded.
Figure 4A:
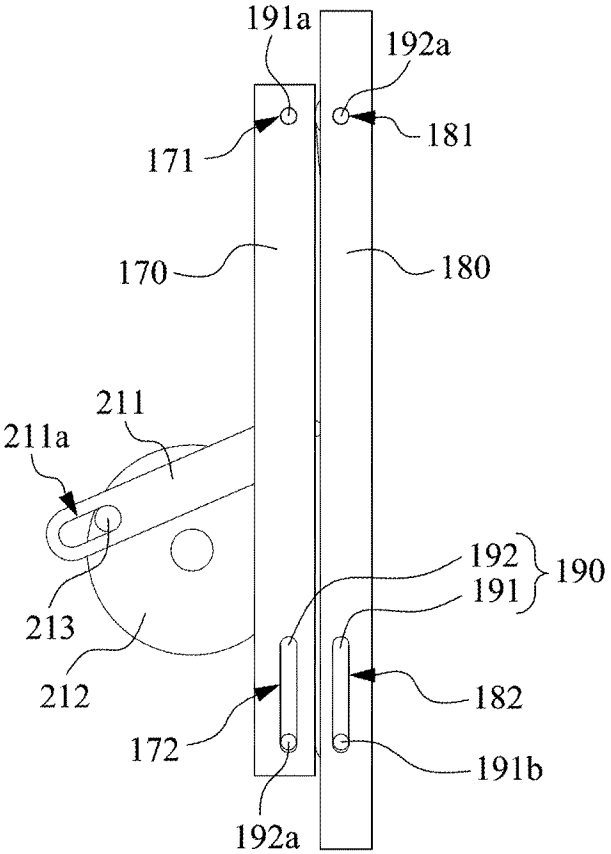
FIG. 4A illustrates a schematic view of a fixing member, a pushing plate, a scissor-like linkage set, and some parts of a power transmission assembly shown in FIG. 3, in which the scissor-like linkage set 190 is folded.

Please refer to FIG. 4A and FIG. 4B. FIG. 4A illustrates a schematic view of a fixing member 170, the pushing plate 180, a scissor-like linkage set 190, and some parts of a power transmission assembly 210 shown in FIG. 3, in which the scissor-like linkage set 190 is folded. FIG. 4B illustrates another schematic view of the elements shown in FIG. 4A, in which the scissor-like linkage set 190 is unfolded.

Figure 6A:
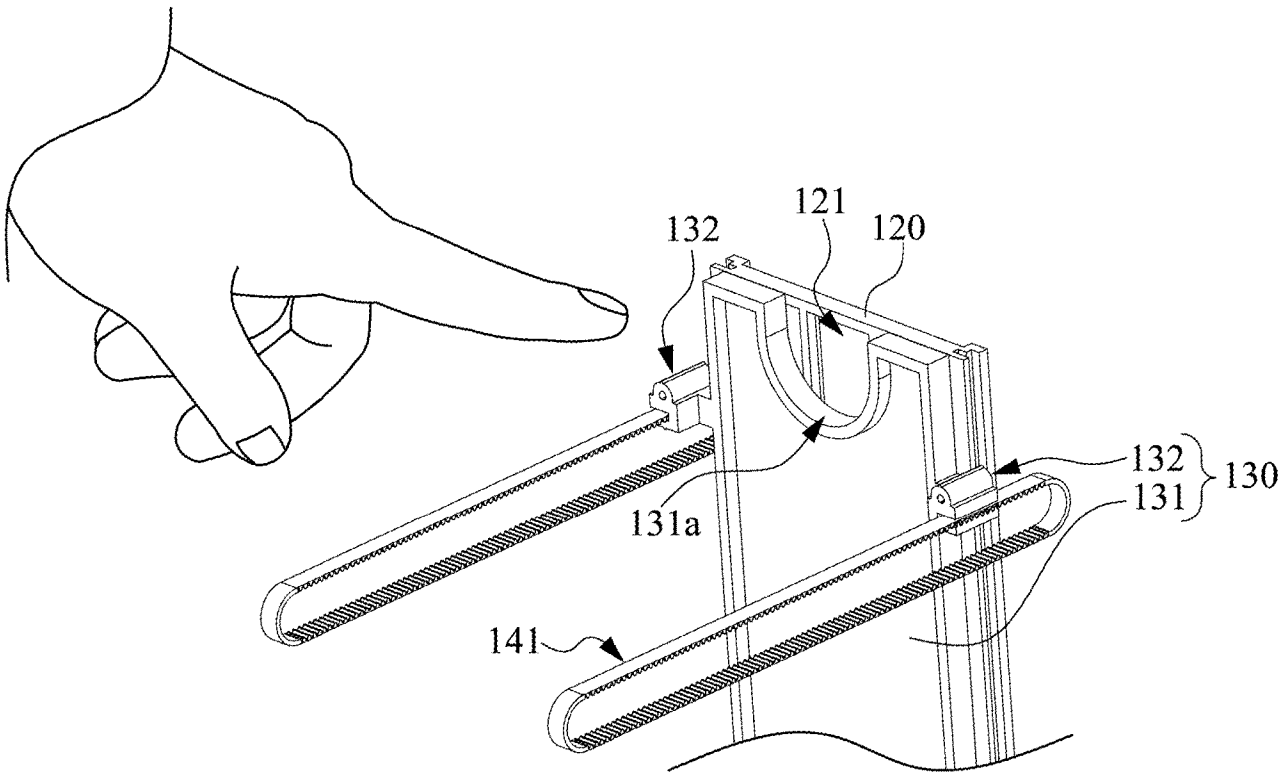
FIG. 6A illustrates a schematic partial perspective view of the guiding plate, the supporting plate, and a part of first belts shown in FIG. 1A.

As shown in FIG. 3 to FIG. 4B, in the present disclosure, the document storage assembly 100 further includes a fixing member 170, a scissor-like linkage set 190, and a power transmission assembly 210. The fixing member 170 is disposed in the housing 110. The guiding plate 120 is located between the fixing member 170 and the supporting plate 130. The pushing plate 180 is disposed in the housing 110. As shown in FIG. 1A, FIG. 1B, and FIG. 6A, the guiding plate 120 further has a passage 121. The pushing plate 180 is configured to push the supporting plate 130 through the passage 121. The scissor-like linkage set 190 is connected between the fixing member 170 and the pushing plate 180, and is configured to drive the pushing plate 180 to move towards or away from the fixing member 170 along the direction A-A'. The power transmission assembly 210 is disposed in the housing 110, and is configured to drive the scissor-like linkage set 190 by using a driving arm 211, so as to drive the pushing plate 180 to move towards or away from the fixing member 170.

Specifically, as shown in FIG. 4A and FIG. 4B, the fixing member 170 is disposed with a first pivoting portion 171 and a first sliding groove 172. The pushing plate 180 has a second pivoting portion 181 and a second sliding groove 182. The first sliding groove 172 and the second sliding groove 182 are located at same sides of the first pivoting portion 171 and the second pivoting portion 181 respectively. The scissor-like linkage set 190 includes a first linkage 191 and a second linkage 192. The first linkage 191 has a first pivoting end 191*a* and a first sliding end 191*b* which are engaged with the first pivoting portion 171 and the second sliding groove 182 respectively. The second linkage 192 has a second pivoting end 192*a* and a second sliding end 192*b* which are engaged with the second pivoting portion 181 and the first sliding groove 172 respectively. The power transmission assembly 210 includes the driving arm 211, a gear plate 212, and a bump 213. The driving arm 211 is connected to the scissor-like linkage set 190, and has a long slot 211*a*. The gear plate 212 is rotatably disposed in the housing 110. The bump 213 is disposed on a plate surface of the gear plate 212, and is slidably engaged in the long slot 211*a*. As such, the power transmission assembly 210 may drive the scissor-like linkage set 190 by using the driving arm 211, so as to drive the pushing plate 180 to move towards or away from the fixing member 170.

By the foregoing configuration, it is guaranteed that the pushing plate 180 may move along the fixed direction A-A' relative to the fixing member 170 without rotating. Therefore, after the pushing plate 180 pushes the document D through the passage 121 of the guiding plate 120 to abut against the supporting plate 130, the document D may be held stably between the pushing plate 180 and the supporting plate 130.

It should be noted that, other elements of the power transmission assembly 210 (not labelled in FIG. 3) may transmit power provided by an external power source (not shown) to the gear plate 212, but the detail description of combinations and connection relationships of the elements are not introduced herein, people with ordinary skill in the industry may implement the present embodiment with reference to FIG. 3.

Figure 5:
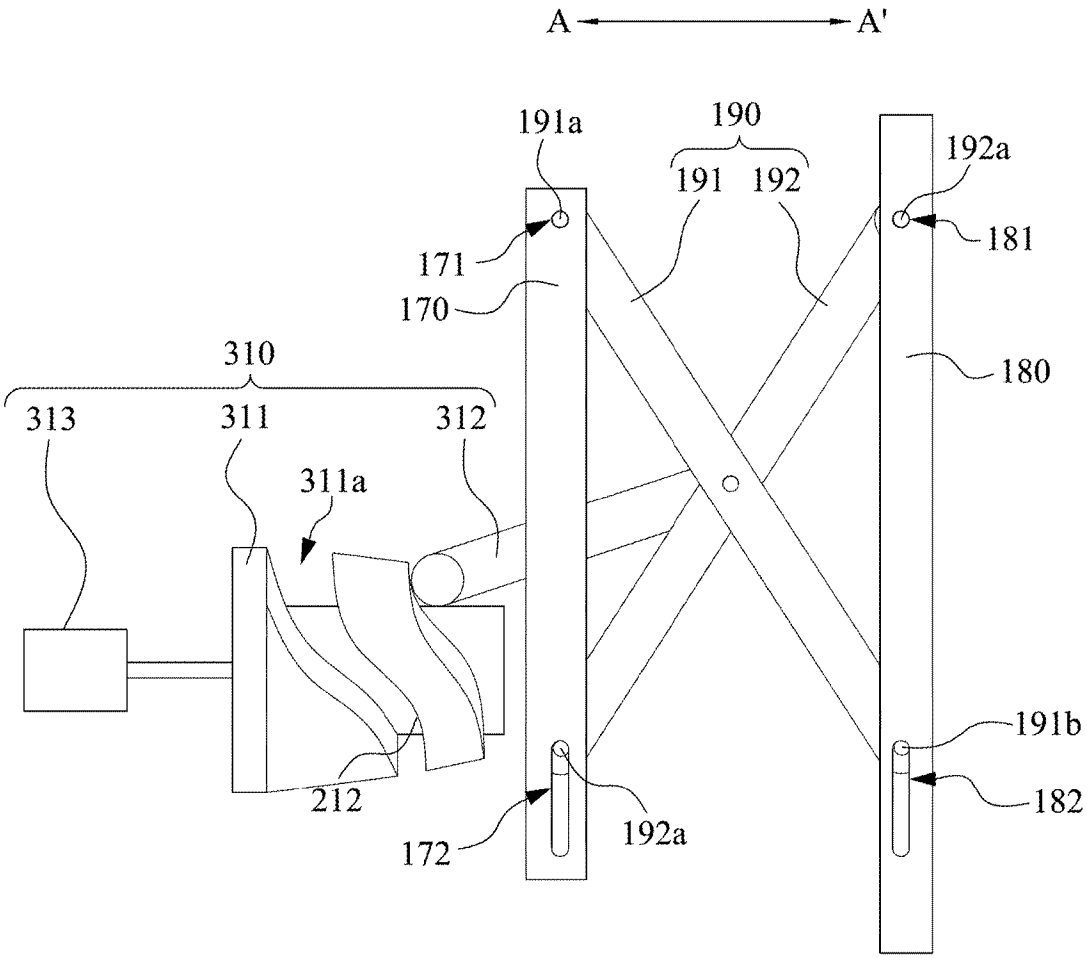
FIG. 5 illustrates a schematic view of a fixing member, a pushing plate, a scissor-like linkage set, and a power transmission assembly according to an embodiment of the present disclosure.

Please refer to FIG. 5, which illustrates a schematic view of the fixing member 170, the pushing plate 180, the scissor-like linkage set 190, and a power transmission assembly 310 according to an embodiment of the present disclosure. As shown in FIG. 5, the fixing member 170, the pushing plate 180, and the scissor-like linkage set 190 are similar to those of the embodiment shown in FIG. 4B, and reference may be made to the previous paragraphs, and thus not repeat herein. It should be noted that the power transmission assembly 310 is modified in the present embodiment. Specifically, the power transmission assembly 310 of the present embodiment includes a cam structure 312, a driven member 311, and a motor 313. The cam structure 312 is rotatably disposed in the housing 110, and has a cam rail 312*a*. The driven member 311 is connected to the scissor-like linkage set 190, and is engaged with the cam rail 312*a*. The motor 313 is disposed in the housing 110, and may drive the cam structure 312 to rotate so as to drive the driven member 311 to move along the direction A-A'. As such, the cam structure 312 may drive the scissor-like linkage set 190 by using the driven member 311, the goal of moving the pushing plate 180 towards or away from the fixing member 170 may be achieved as well.

Figure 6B:
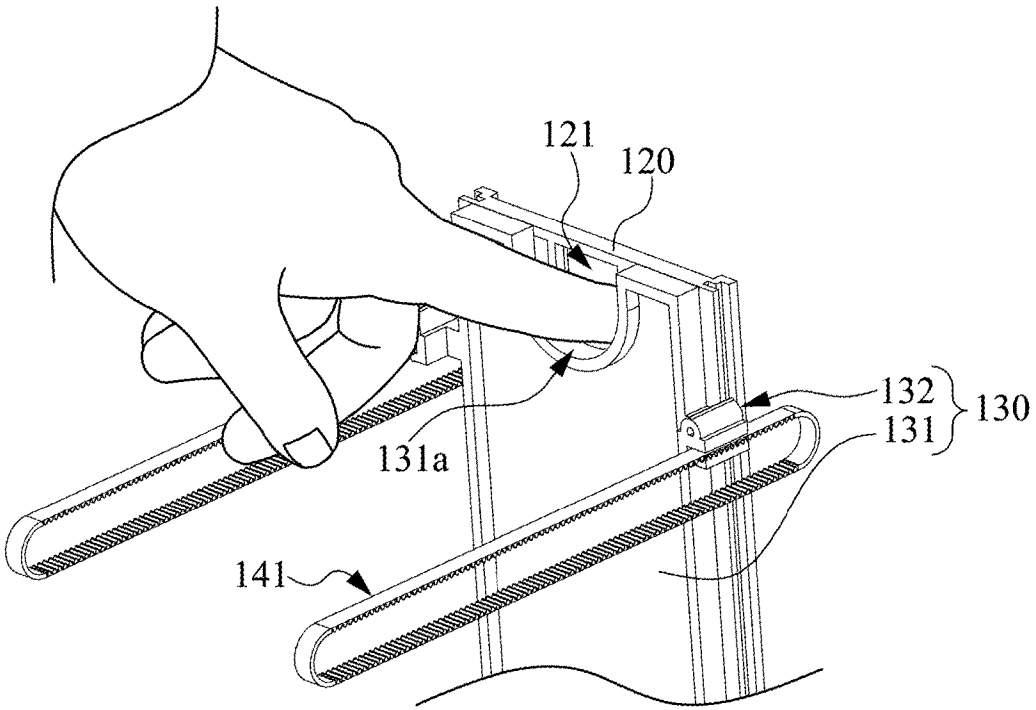
FIG. 6B and FIG. 6C illustrate schematic partial views of pulling a supporting plate away from a guiding plate by fingers.
Figure 6C:
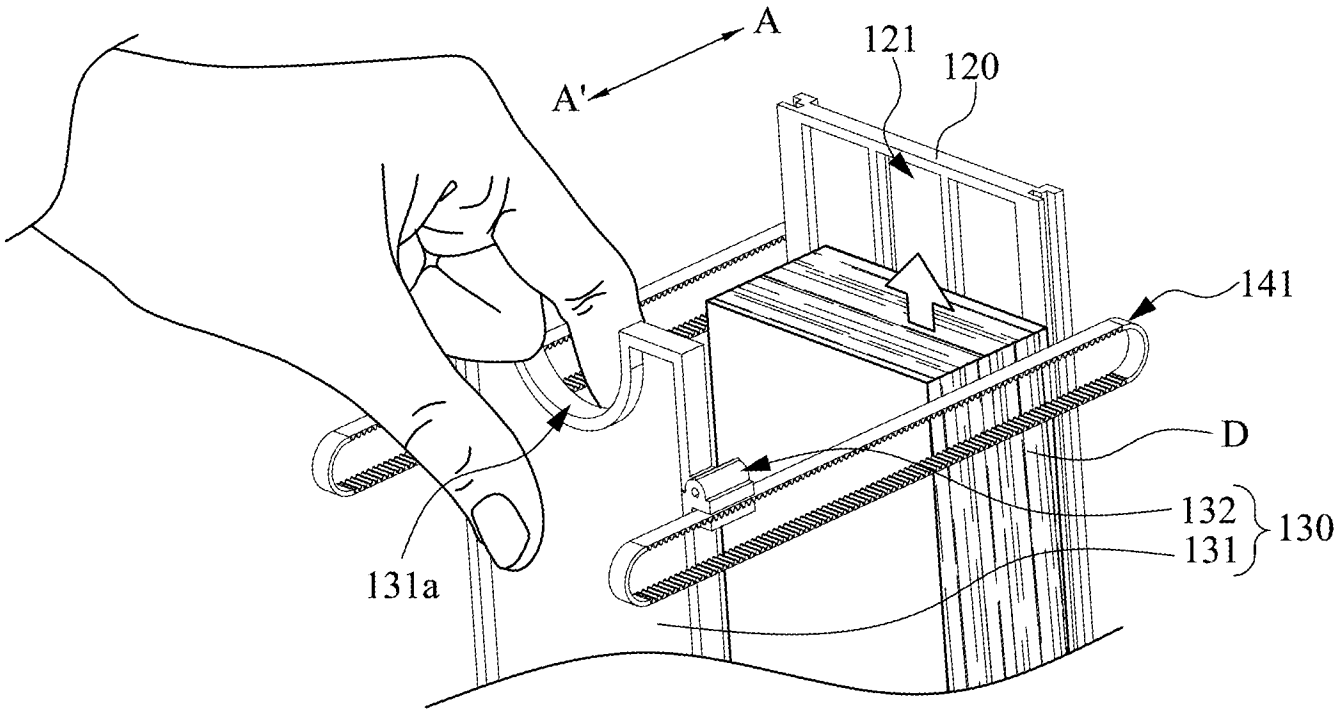

Please refer to FIG. 6A to FIG. 6C. FIG. 6A illustrates a schematic partial perspective view of the guiding plate 120, the supporting plate 130, and a part of the first belts 141 shown in FIG. 1A. FIG. 6B and FIG. 6C illustrate schematic partial views of pulling the supporting plate 130 away from the guiding plate 120 by fingers. As shown in FIG. 6A to FIG. 6C, in the present embodiment, an edge of the main body 131 of the supporting plate 130 has an indentation 131*a*. When the supporting plate 130 abuts against the guiding plate 120, the indentation 131*a* is configured to enable a workpiece (for example, the fingers shown in FIG. 6A to FIG. 6C) to pass therethrough and reach the passage 121. As mentioned above, the two first belts 141 (only one is labelled in FIG. 6A to FIG. 6C) may drive the supporting plate 130 by using the engagement structures 132 at an upper portion of the supporting plate 130. As such, when the supporting plate 130 abuts against the guiding plate 120 (for example, when there is no document D between the supporting plate 130 and the guiding plate 120), fingers may pass through the indentation 131*a* between the first belts 141 and reach the passage 121 of the guiding plate 120, and thus the fingers may hold a side of the supporting plate 130 facing towards the guiding plate 120 and pull the supporting plate 130 away from the guiding plate 120 conveniently. As shown in FIG. 6C, after the supporting plate 130 is pulled away from the guiding plate 120, the document D may be taken out between the two first belts 141.

From the detail description of the present disclosure mentioned above, it is apparent that, in the document storage assembly of the present disclosure, the displacement assembly is disposed with the first belts to drive the supporting plate, and the second belts are disposed below the storage space defined between the guiding plate and the supporting plate, and a synchronous transmission assembly is disposed therein to drive the first belts and the second belts to move at the same speed. Therefore, after the document enters the storage space, the document may be supported on the second belts and move with the supporting plate, so as to prevent the document from falling down due to the friction rubbing with a bottom side of the housing, and thus the document storage assembly of the present disclosure may effectively arrange the stored document in the storage space in order. Also, in the document storage assembly of the present disclosure, the pushing plate is guided by the scissor linkage set to move relatively to the fixing member, and the fixing member and the pushing plate each of which has a pivoting portion and a sliding groove, so as to connect with the scissor linkage set. By designing the sliding grooves on the fixing member and the pushing plate to be located at same side of the pivoting portions, it can be guaranteed that the pushing plate will move along a fixed direction relatively to the fixing member without rotating. In addition, in the document storage assembly of the present disclosure, an edge of the supporting plate has an indentation. When the supporting plate abuts against the guiding plate (for example, when there is no document between the supporting plate and the guiding plate), fingers may pass through the indentation and reach the passage of the guiding plate, so as to allow the user to pull the supporting plate away by hands conveniently.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A document storage assembly, comprising:

a housing;

a guiding plate disposed in the housing;

a supporting plate that is disposed in the housing and has at least one engagement structure, wherein a storage space is defined between the guiding plate and the supporting plate; and a displacement assembly disposed in the housing and configured to move the supporting plate towards or away from the guiding plate along a direction, wherein the displacement assembly comprises:

at least one first belt that has an engaging section parallel to the direction and is engaged with the engagement structure;

at least one second belt that is located under the storage space and has a supporting section parallel to the direction; and a synchronous transmission assembly that is operatively connected to the first belt and the second belt, and is configured to drive the engaging section and the supporting section to move at the same speed.

2. The document storage assembly of claim 1, wherein the displacement assembly further comprises:

at least one first gear rotatably disposed in the housing, wherein the first belt is sleeved onto the first gear, so as to be driven by the first gear; and at least one second gear rotatably disposed in the housing, wherein the second belt is sleeved onto the second gear, so as to be driven by the second gear.

3. The document storage assembly of claim 2, wherein the displacement assembly further comprises:

a first rotating shaft rotatably disposed in the housing, wherein the first gear is sleeved onto the first rotating shaft; and a second rotating shaft rotatably disposed in the housing, wherein the second gear is sleeved onto the second rotating shaft.

4. The document storage assembly of claim 3, wherein the synchronous transmission assembly further comprises:

a third gear sleeved onto the first rotating shaft;

a fourth gear sleeved onto the second rotating shaft; and a third belt sleeved onto the third gear and the fourth gear, so as to be driven by the third gear and the fourth gear.

5. The document storage assembly of claim 3, wherein the displacement assembly further comprises at least one supporting wheel rotatably disposed in the housing, wherein the supporting section of the second belt is supported on the supporting wheel.

6. The document storage assembly of claim 5, wherein the displacement assembly further comprises a plurality of the supporting wheels, and the supporting wheels are arranged along the direction.

7. The document storage assembly of claim 3, further comprising a torsion spring that is sleeved onto the first rotating shaft and has a first end and a second end, wherein the first end is fixed to the first rotating shaft, and the second end is configured to abut against an inner wall of the housing.

8. The document storage assembly of claim 1, wherein a number of the at least one first belt is two, and the displacement assembly further comprises:

two first gears rotatably disposed in the housing, wherein the first belts are sleeved onto the first gears respectively, so as to be driven by the first gears;

a first rotating shaft rotatably disposed in the housing, wherein one of the first gears is sleeved onto the first rotating shaft; and a second rotating shaft rotatably disposed in the housing, wherein the other one of the first gears is sleeved onto the second rotating shaft.

9. The document storage assembly of claim 1, wherein the engaging section has a first meshing portion, and the engagement structure further comprises:

a sliding block having a guiding groove configured to accommodate a portion of the engaging section, wherein the guiding groove has a second meshing portion engaged with the first meshing portion; and an abutting member disposed in the guiding groove and configured to prevent the first meshing portion from disengaging from the second meshing portion.

10. The document storage assembly of claim 9, wherein the engagement structure further comprises a fastening member configured to fasten the abutting member to the sliding block.

11. The document storage assembly of claim 9, further comprising two guiding bars that are disposed on an inner wall of the housing and substantially extend along the direction, wherein the sliding block is limited between the guiding bars.

12. The document storage assembly of claim 1, further comprising two guiding stages disposed in the housing, wherein the guiding stages are adjacent to two side edges of the guiding plate and the supporting plate respectively, and the storage space is further defined within the guiding stages.

13. The document storage assembly of claim 1, wherein the guiding plate further has a passage, and the document storage assembly further comprises:

a fixing member disposed in the housing, wherein the guiding plate is located between the fixing member and the supporting plate;

a pushing plate disposed in the housing and configured to pass through the passage to abut against the supporting plate;

a connecting assembly that is connected between the fixing member and the pushing plate, and is configured to drive the pushing plate to move towards or away from the fixing member along the direction; and a power transmission assembly disposed in the housing and comprising:

a cam structure that is rotatably disposed in the housing and has a cam rail; and a driven member connected to the connecting assembly and engaged with the cam rail, wherein the cam structure is configured to drive the connecting assembly by using the driven member, so as to drive the pushing plate to move towards or away from the fixing member.

14. A document storage assembly, comprising:

a housing;

a fixing member that is disposed in the housing and has a first pivoting portion and a first sliding groove;

a pushing plate that is disposed in the housing opposite to the fixing member, and has a second pivoting portion and a second sliding groove, wherein the first sliding groove and the second sliding groove are located at same sides of the first pivoting portion and the second pivoting portion respectively;

a scissors-like linkage set, comprising:

a first linkage having a first pivoting end and a first sliding end that are engaged with the first pivoting portion and the second sliding groove respectively; and a second linkage having a second pivoting end and a second sliding end that are engaged with the second pivoting portion and the first sliding groove respectively; and a power transmission assembly disposed in the housing, the power transmission assembly comprising a driving arm connected to the scissors-like linkage set, wherein the power transmission assembly is configured to drive the scissors-like linkage set by using the driving arm, so as to move the pushing plate towards or away from the fixing member.

15. The document storage assembly of claim 14, wherein the driving arm has a long slot, and the power transmission assembly further comprises:

a gear plate rotatably disposed in the housing; and a bump that is disposed on a plate surface of the gear plate and is slidably engaged into the long slot.

16. A document storage assembly, comprising:

a housing;

a guiding plate disposed in the housing and having a passage;

a supporting plate disposed in the housing, wherein an edge of the supporting plate has an indentation;

a pushing plate disposed in the housing and configured to pass through the passage to abut against the supporting plate; and a displacement assembly disposed in the housing and configured to drive the supporting plate to move towards or away from the guiding plate, wherein when the supporting plate abuts against the guiding plate, the indentation is configured to enable a workpiece to pass therethrough and reach the passage.

17. The document storage assembly of claim 16, wherein an orthogonal projection of the indentation on the guiding plate partially overlaps with the passage.

18. The document storage assembly of claim 16, wherein the supporting plate comprises two engaging structures, the indentation is located between the engaging structures, and the displacement assembly comprises:

two belts each of which has an engaging section, wherein the engaging sections are parallel to a direction and are engaged with the engaging structures respectively, so as to drive the supporting plate to move towards or away from the guiding plate along the direction.

19. The document storage assembly of claim 16, wherein the indentation is U-shaped.

20. The document storage assembly of claim 16, further comprising:

a fixing member disposed in the housing, wherein the guiding plate is located between the fixing member and the supporting plate;

a pushing plate disposed in the housing and configured to pass through the passage to abut against the supporting plate;

a connecting assembly that is connected between the fixing member and the pushing plate, and is configured to drive the pushing plate to move towards or away from the fixing member; and a power transmission assembly disposed in the housing and comprising:

a cam structure that is rotatably disposed in the housing and has a cam rail; and a driven member that is connected to the connecting assembly and is engaged with the cam rail, wherein the cam structure is configured to drive the connecting assembly by using the driven member, so as to drive the pushing plate to move towards or away from the fixing member.

* * * * *